US005163520A

United States Patent [19]

Gibson et al.

[11] Patent Number: 5,163,520

[45] Date of Patent: Nov. 17, 1992

[54] APPARATUS AND METHOD FOR STEERING A PIPE JACKING HEAD

[75] Inventors: Paul N. Gibson, Saulda, S.C.; Wm. M. Hogan, Jacksonville, Ark.

[73] Assignee: Lag Steering Systems, Rocky Mt., N.C.

[21] Appl. No.: 698,936

[22] Filed: May 13, 1991

Related U.S. Application Data

[63] Continuation-in-part of Ser. No. 646,852, Jan. 28, 1991, and a continuation-in-part of Ser. No. 656,855, Feb. 19, 1991, Pat. No. 5,099,927.

[51] Int. Cl.[5] ..... E21B 7/04; E21B 47/024

[52] U.S. Cl. ..... 175/19; 175/45; 175/61; 175/73

[58] Field of Search ..... 175/45, 61, 62, 19, 175/27, 73, 77, 75

[56] References Cited

U.S. PATENT DOCUMENTS

| | | | |
|---|---|---|---|
| 3,581,404 | 6/1971 | Sanfead | 175/45 X |
| 3,589,454 | 6/1971 | Coyne | 175/45 X |
| 4,361,192 | 11/1982 | Trowsdale | 175/45 |
| 4,674,579 | 6/1987 | Geller et al. | 175/45 |
| 4,823,888 | 4/1989 | Smet | 175/45 |
| 4,907,658 | 3/1990 | Stangl et al. | 175/45 X |
| 4,953,638 | 9/1990 | Dunn | 175/45 X |
| 5,002,137 | 3/1991 | Dickinson et al. | 175/45 X |

*Primary Examiner*—Stephen J. Novosad
*Attorney, Agent, or Firm*—Cort Flint

[57] ABSTRACT

An apparatus and method for steering pipe casing laid underground is disclosed which includes a steerable pipe jacking head attached to a forward pipe casing and pushed through the ground by a string of pipe casings from a pipe pushing or jacking machine at a station below or above the ground. A steering wedge which may be rotated to a desired steering position and then extended from the forward end of the pipe jacking head is disclosed which accurately steers the pipe jacking head in horizontal and vertical directions. An inclinometer is used to measure the vertical position of the pipe jacking head. A directional heading sensor which includes a toroidal fluxgate magnetometer with a free floating ring core is utilized to measure the horizontal position of the pipe jacking head. Horizontal and vertical position signals, and the rotational position of the steering wedge, are measured and transmitted as serial data to a computer where the signals are processed and displayed graphically on a display screen. From the vertical and horizontal deviations in position, and the rotational position of the steering wedge, an operator may manually control the rotational position of the steering wedge and the extension and retraction of the steering wedge from the pipe jacking head to steer to head and pipe casings along a prescribed path.

36 Claims, 4 Drawing Sheets

APPARATUS AND METHOD FOR STEERING A PIPE JACKING HEAD

This is a continuation-in-part of co-pending application Ser. No. 646,852, filed Jan. 28, 1991, entitled DIRECTIONAL DRILLING SYSTEM WITH ECCENTRIC MOUNTED MOTOR AND BIAXIAL SENSOR, and application Ser. No. 656,855, filed Feb. 19, 1991, now U.S. Pat. No. 5,099,927, entitled APPARATUS FOR GUIDING AND STEERING EARTH BORING CASING.

BACKGROUND OF THE INVENTION

This invention relates to a steerable pipe jacking head for laying small diameter pipes such as gas, water, and the like conduits, precisely in position underground. In particular, the invention relates to an apparatus and method for steering a pipe jacking head in two degrees of freedom, i.e. vertical and horizontal directions.

Heretofore, apparatus have been provided for laying pipes in the ground such as drainage, gas, water pipes, and the like, of relatively small diameter. Typically, pipe casings are pushed through the ground by the use of a hydraulic jack which advances a link of pipe casing underground and then is retracted. A new link of pipe casing is then threaded onto the advanced pipe casing and is itself advanced. The procedure is repeated until a desired length of pipe casing has been pushed underground. The problem arises of steering the string of pipe casings as they are pushed through the ground. Often, it is necessary to go underneath a conduit, creek bed, and the like, so that the desired path for the pipe casing is usually not straight. In any event, it is difficult to maintain a straight advance of the laid in pipe casings. It has been proposed to provide a detector pipe extending along the axis of the laid in pipes which may be detected so as to measure a vertical position of the forward end of the laid in pipe casings. Typically, a transmitter is located at the forward end of pipe casings and a receiver is utilized above ground to locate the forward end of the pipe casings. However, this is not entirely reliable since there are numerous factors underground which can interfere with the transmission and accuracy of the signal. Even if the vertical position of the front end of the pipe is known, it is often difficult to steer the string of laid in pipe casings when deviations occur in the detected vertical position. While the problems of detecting and steering in regards to vertical positions are difficult, the measuring and steering in a horizontal plane are even more difficult. The directional control of small diameter pipes which are pushed through the ground requires not only skilled operators, but reliable means of measuring the position and then steering the forward end of the pipe casings. Suitable measuring and steering devices have not been provided by the prior art. U.S. Pat. No. 4,026,371 discloses a pilot head for laying small diameter pipes which comprises an expandable and contractible pilot jack disposed within a pilot casing, a pivoting cylinder adapted for pivoting the pilot jack in a selected direction in a plane normal to the central axis of the pilot head, and an electromagnetic valve for operating the cylinder. A clinometer is used for detecting the vertical position angle and direction of the pilot head. However, the mechanism for pivoting the pilot jack involves ball joints which easily become worn, particularly when considering the pressure exerted on such a pipe jack due to the compression of the soil as the pipe head is advanced by a hydraulic or other jack through the ground. While the patent discloses both measuring the vertical position with a clinometer and/or transit, there is no means provided for measuring the horizontal position or for steering the pipe head according to a desired heading. Even if a cased bore is formed with pipe casings along a desired vertical direction, many times the cased bore will be off several feet to the left or right. When this occurs, it is often necessary to relay the pipe casings to form another cased bore, hopefully more accurately in line. This involves considerable additional expense and effort. It is not guaranteed that the second cased bore will be any more accurate in its horizontal position than the first.

Accordingly, the problem of measuring the vertical and horizontal positions of a pipe casing which is jacked or pushed through the ground, and of steering a forward end of the pipe casing in both a horizontal and vertical direction, is a problem to which considerable attention need be given.

Accordingly, an object of the invention is to provide an apparatus and method for guiding and steering a pipe jacking head in two degrees of freedom.

Another object of the invention is to provide a simple, yet reliable, means for guiding and measuring a steerable pipe jacking head in two degrees of freedom, that is both the horizontal and vertical directions.

Another object of the invention is to provide an apparatus and method which is simple in construction and yet is effective for steering a pipe jacking head in both a horizontal and vertical direction as pipe casing is pushed underground from a pit station.

Another object of the invention is to provide an effective steering device for a steerable pipe jacking head which may be extended to steer the pipe jacking head and change direction and then retract it so that the pipe jacking head may be pushed in that direction until a further direction change is needed.

Another object of the invention is to provide a simple and reliable guidance system for measuring the horizontal and vertical positions of a steerable pipe jacking head having such an effective steering device.

SUMMARY OF THE INVENTION

The above objectives are accomplished according to the present invention by providing a pipe jacking head which can be steered for laying pipe casings underground to form a cased bore. The steerable pipe jacking head is carried by the forward pipe casing. A steering device, preferably a wedge, is carried by the pipe jacking head for creating a directional steering force to steer the head in a prescribed direction. The steering wedge has a desired rotational position in which the steering wedge creates the directional steering force to steer the pipe jacking head, and an advanced position in which the steering wedge is extended forward of the pipe jacking head to steer the pipe jacking head, and a retracted position in which the steering wedge is retracted within the pipe jacking head so that the directional force is not created. An actuator is provided for rotating the steering wedge to a desired rotational position and for moving the steering wedge between the advanced and retracted positions. The actuator includes a first actuator for rotating the steering wedge to the desired rotational position corresponding to the prescribed direction, and a second actuator for reciprocating the steering wedge in and out of the pipe jacking head between advanced and retracted positions. The second actuator includes a fluid cylinder which has a piston rod attached to the steering wedge. The wedge has a slanted surface which creates the directional force. The first actuator includes a drive motor for rotating the steering wedge to the desired rotational position, and a coupling which connects the steering wedge and drive motor for rotating the steering wedge and permitting the steering wedge to be extended along a longitudinal axis of the pipe jacking head. A guidance system measures an inclination and a heading of the pipe jacking head and generates corresponding first and second position signals. A control controls the first and second actuators in response to the first and second position signals to control the steering wedge to steer the pipe jacking head according to a prescribed path. The guidance system includes a first sensor for measuring the inclination of the pipe jacking head and generating the first position signal. A second sensor measures the heading of the pipe jacking head and generates the second position signal. A rotary sensor is provided for detecting the rotational position of the steering wedge and for generating a rotational position signal. A computer processes the first and second position signals and calculates vertical and horizontal deviations of the pipe jacking head with respect to the prescribed path, and processes the rotational position signal. A visual display graphically displays the deviations of the pipe jacking head, and the rotational position of the steering wedge. The control device comprises manually operated controller for controlling the first and second actuators in response to the display of deviations and rotational position to move the steering wedge and steer the pipe jacking head to nullify the deviations. Preferably, the second sensor includes a magnetometer sensor, and compensation circuit for compensating for magnetic field anomalies to eliminate errors in the second position signal caused by field anomalies.

The method of the invention for steering and guiding a steerable pipe jacking head which lays pipe casings underground includes providing a steerable pipe jacking head having a steering device which is rotated within the pipe jacking head to a desired rotated position corresponding to a desired steering direction. The steering device is extended from the pipe jacking head to steer the pipe jacking head, and then retracted so as not to steer the pipe jacking head. The position of the pipe jacking head is measured as it is pushed through the ground to lay pipe casings and position signals are generated. Next, the method includes rotating and then extending the steering device in response to position signals to steer the pipe jacking head as it is pushed through the ground in a prescribed direction along a desired path, and then retracting the steering device after the pipe jacking head has been steered to a prescribed direction. Preferably, the steering device is provided in the form of a steering wedge having a slanted surface which creates a directional force to steer the pipe jacking head. Measuring the position of the pipe jacking head is accomplished by measuring the inclination of heading of the pipe jacking head, and generating inclination and heading signals. The rotational position of the steering wedge is detected and a rotation position signal is generated. The rotational position of the steering wedge is controlled in response to inclination and heading signals and rotational position signal to steer the pipe jacking head along the prescribed path.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 2:
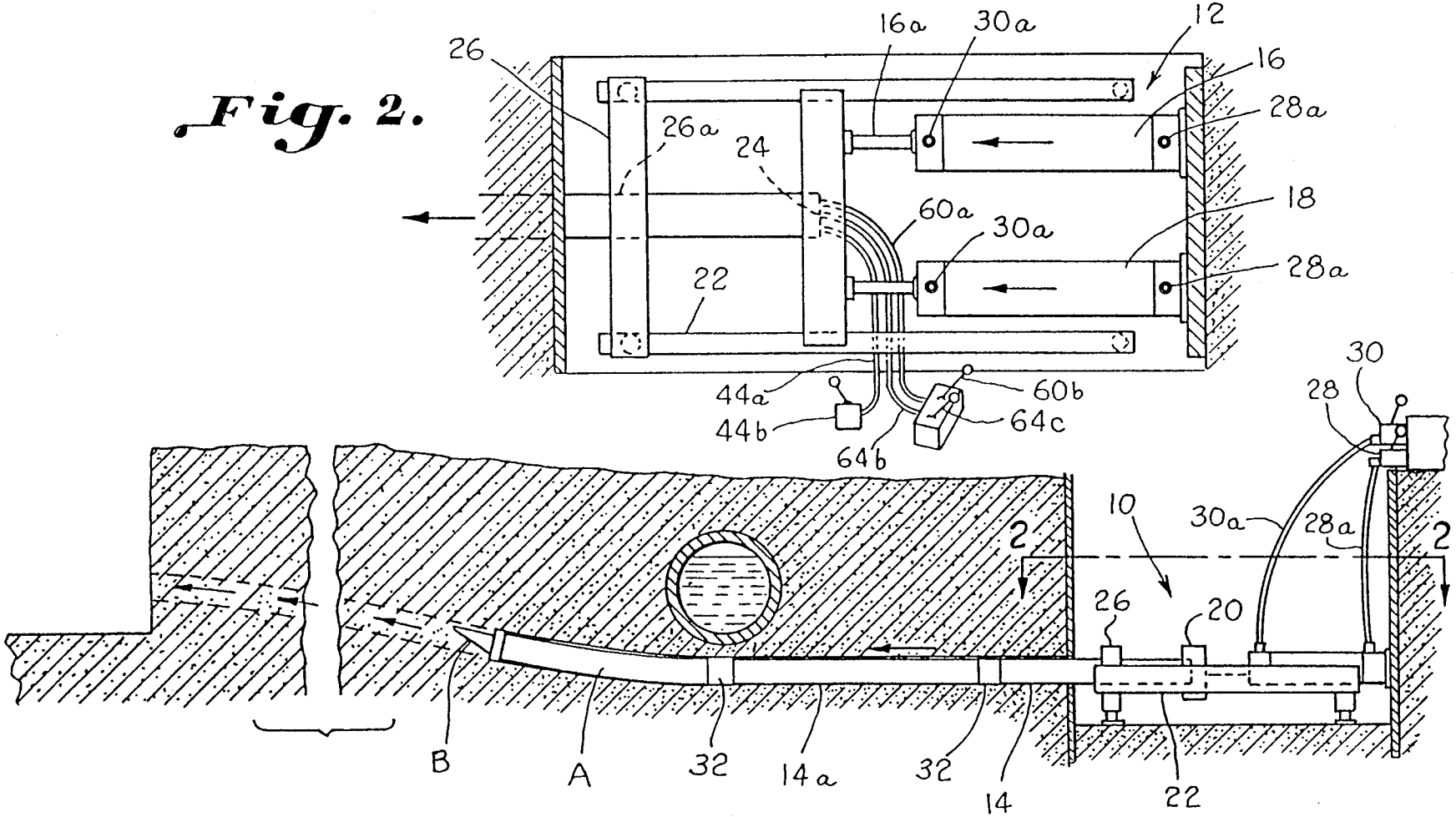
FIG. 1 is a side elevation illustrating an apparatus and method for pushing small diameter pipe casings underground using a steerable pipe jacking head according to the apparatus and method of the invention.
FIG. 2 is a sectional view taken along line 2—2 of FIG. 1.

Referring now in more detail to the drawings, an apparatus and method laying small diameter pipe casings underground is illustrated which includes a boring pit 10 having a hydraulic jack, designated generally as 12, which pushes pipe casings 14 underground in a conventional manner. While the pit is illustrated underground, the apparatus and method of the present invention may be utilized and carried out from above ground as well. In that case, the pipe casing may be pushed through the ground with a desired entry angle and the vertical position of the pipe casing is controlled accordingly. As can best be seen in FIGS. 1 and 2, pipe jacking apparatus includes a pair of hydraulic cylinders 16 and 18 which have piston rods **16*a* and 18*a* connected to a push bar 20. A push bar slides along a track which includes a pair of rails 22. Push bar 20 includes a recess 24 which receives a butt end of a pipe casing for pushing the pipe casing through the ground. Typically, pipe casings 14 have an outside diameter of 5 inches and a length of 52 inches. There is an alignment collar 26 which has a central aperture 26*a* through which pipe casings 14 are received and aligned for being pushed through the ground, as can best be seen in FIG. 1. Hydraulic cylinders 16, 18 are controlled by suitable controls 28 and 30. Control 28 extends hydraulic piston 16*a*, 18*a* to push pipe casings 14 through the ground via push bar 20, and control 30 admits pressurized fluid to the opposite end of the hydraulic cylinders for retracting the push bar so that a new pipe casing may be threaded into the prior pipe casing for pushing further casings through the ground. For this purpose, threaded couplings are provided at 32 for coupling pipe casing sections together in a conventional manner. There is a forward pipe casing 14*a*** which is threaded into a steerable pipe jacking head A which is constructed in accordance with the apparatus and method of the present invention. Steerable pipe jacking head A includes a steering means B which creates a directional force to steer the pipe jacking head in a desired direction, as will be more fully explained.

Figure 3:
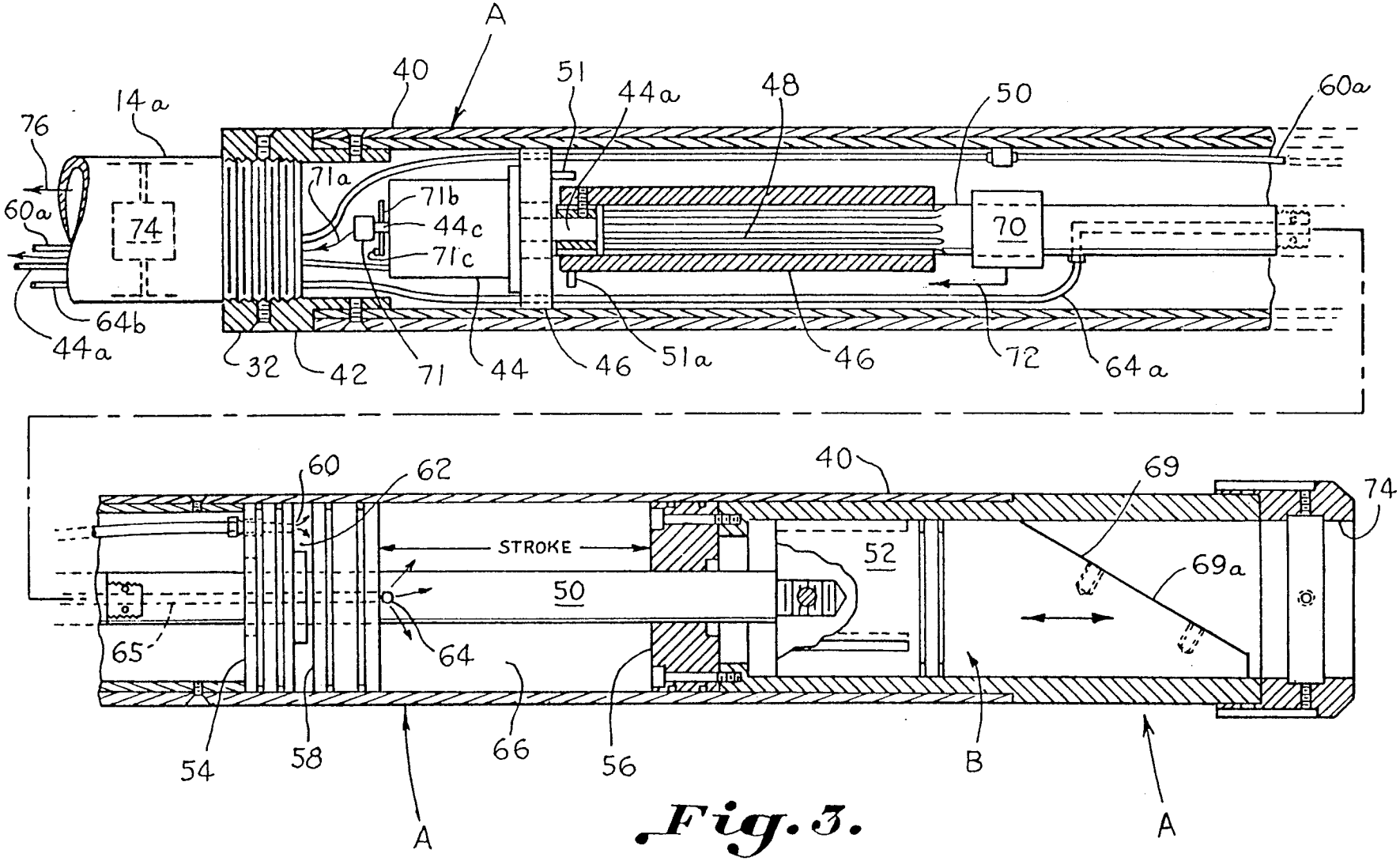
FIG. 3 is a sectional view of a steerable pipe jacking head constructed in accordance with the invention.
Figure 4:
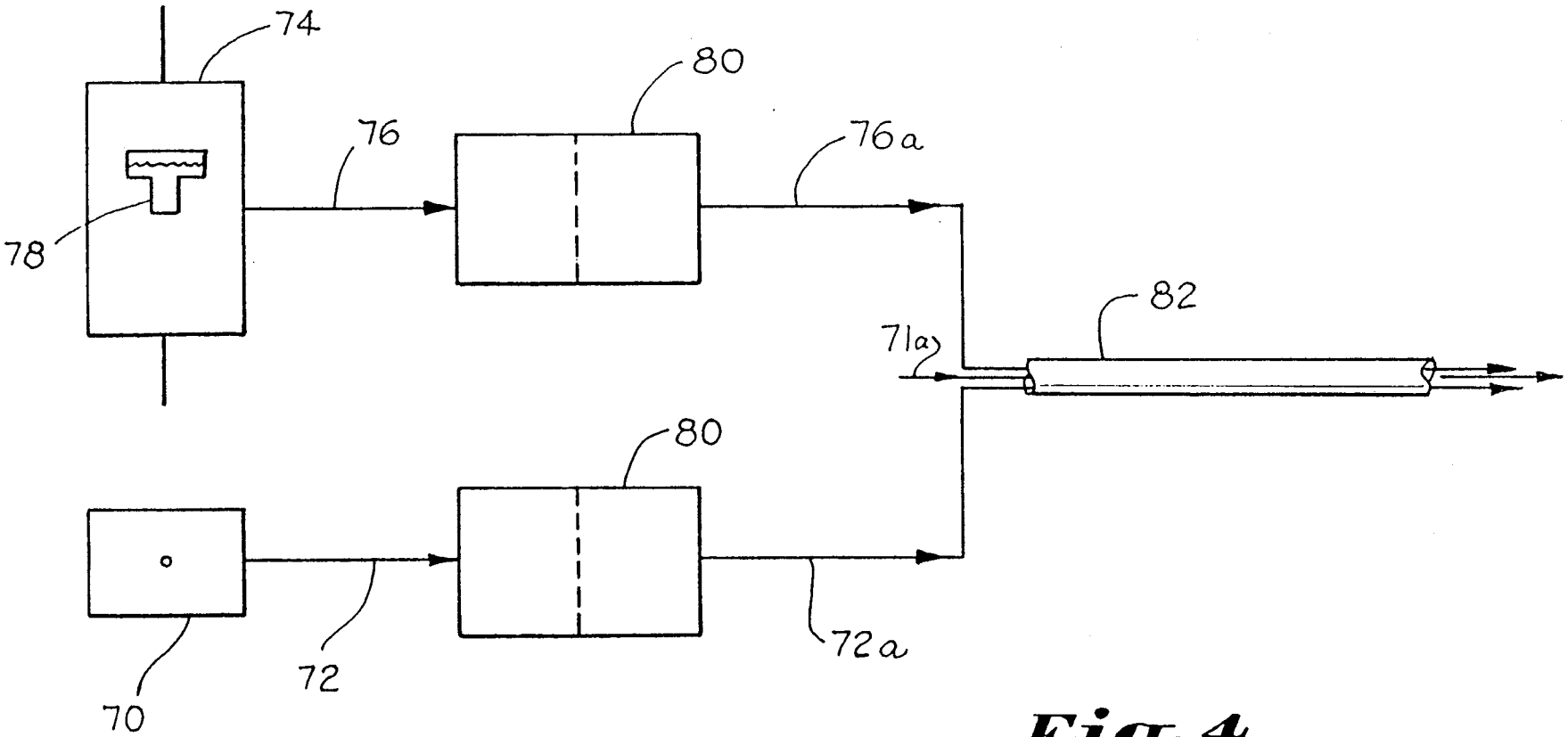
FIG. 4 is a schematic diagram illustrating a guidance system for a steerable pipe jacking head according to the invention.
Figure 5:
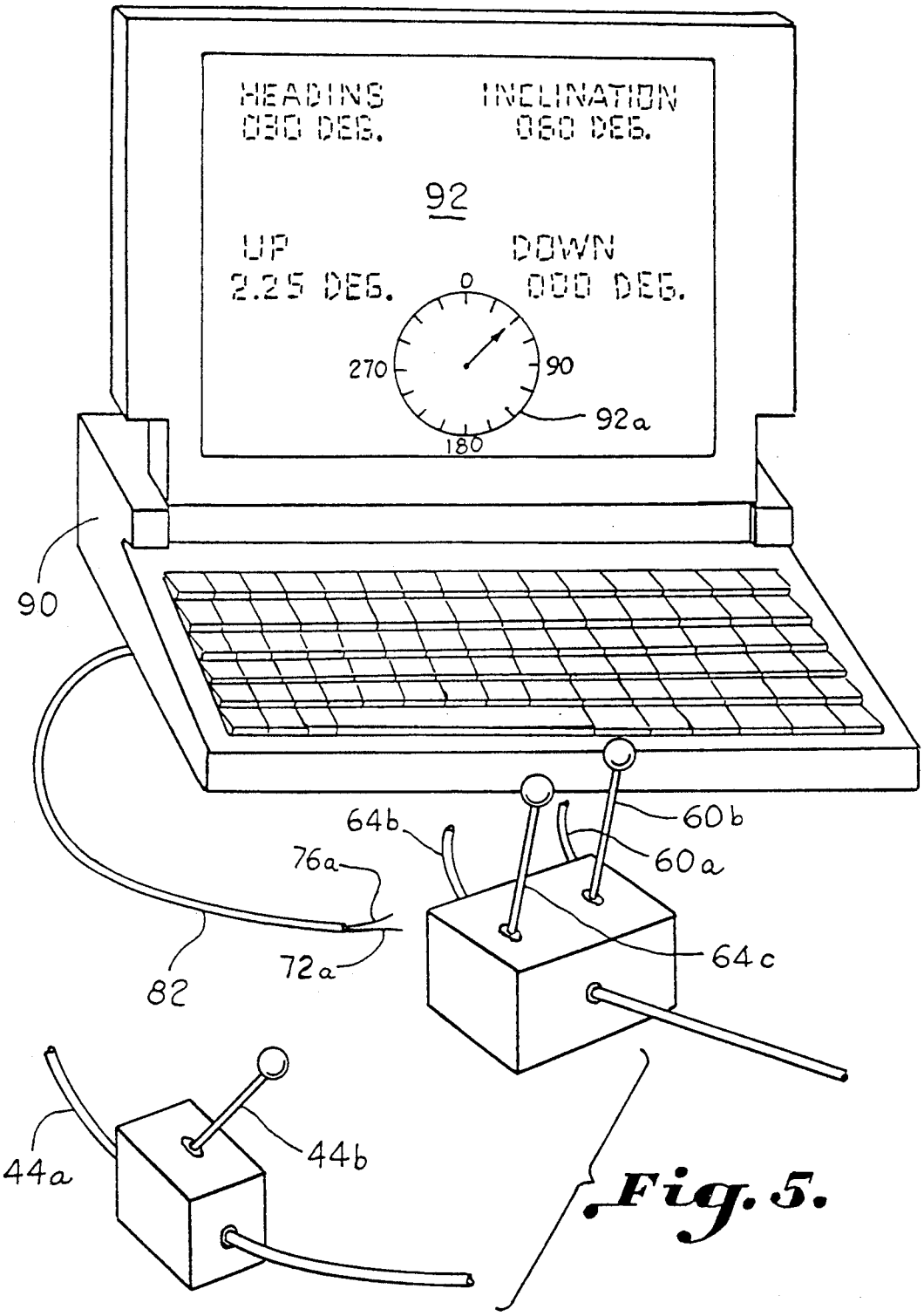
FIG. 5 is a perspective view illustrating a computer processor and display, and manual control for controlling a steerable pipe jacking head according to the invention.

As can best be seen in FIG. 3, pipe jacking head A includes a main housing 40. There is a rear plug 42 into which forward pipe casing 14*a* is threaded. There is a fluid motor 44 which may be any suitable hydraulic motor carried by a motor mount 46 within housing 40. There is a coupling means in the form of a splined coupling 46 which connects an output shaft 44*a* of motor 44 to a splined end 48 of a piston rod 50. This allows piston rod to slide axially within the coupling means while it is rotated by hydraulic motor 44 for purposes that will be more fully explained later. There is a rotation stop 51 carried by mounting plate 46 and a rotation stop 51*a* carried by splined coupling 46. The rotation stops allow for rotation of piston rod 50 in 359 degrees of rotation, but not continuous rotation. Means for rotating hydraulic motor 44 include a fluid line 44*a* which is connected to a manual control valve 44*b* at the pit station (FIG. 2). Control 44*b* is controlled manually by the operator. There is a piston cylinder 52 carried within main housing 40 which includes a first cylinder end cap 54 and second cylinder end cap 56. There is a slidable piston 58 carried within fluid cylinder 52. Preferably, fluid cylinder 52 utilizes a hydraulic fluid. There is an advance port 60 which admits hydraulic fluid through a hydraulic line 60*a* to a space 62 between cylinder end cap 54 and slidable piston 58 for advancing piston 58 and piston rod 50. Hydraulic line 60*a* is connected to a manual control valve 60*b* at the pit station for admitting fluid for advancing piston rod 50. There is a retraction port 64 formed in piston rod 50 which communicates with a space 66 between second cylinder end cap 56 and slidable piston 58 for retracting the slidable piston and piston rod 50. For this purpose, there is a hydraulic line 64*a* communicating with retraction port 64 which includes a bore 65 formed in the interior of piston rod 50 and a flexible hydraulic line 64*b* which is routed through the interior of main housing 40 and pipe casings 14*a* and 14 to the pit station and is controlled by a manual control 64*c*. In this manner, piston rod 50 is rotated by manual control 44*b* and piston rod 50 is reciprocated in extended and retracted positions by controls 60*b* and 64*c*, respectively. Steering means B is carried at the end of piston rod 50 and affixed thereto in the form of a piston wedge 69 having a slanted face 69*a* which creates a directional steering force when extended forward of a plug opening 74 carried at a front end of pipe jacking head A.

In accordance with the apparatus and method of the present invention, steering wedge B is rotated by hydraulic motor 44 and control 44*b* to a desired position so that when slanted face 42 is extended into the soil and pipe casing is pushed, directional steering force is created which steers the pipe jacking head, and attached pipe casings 14, in the desired direction to correct for deviations in the position of the pipe jacking head with respect to horizontal and vertical position angles. As it is understood, of course, in operation, that pipe jacking head A and pipe casings 14 do not rotate, but are pushed through the underground without rotation. Once the desired direction change has occurred by way of steering wedge 60, the steering wedge is retracted to the position shown in FIG. 3 and the pipe casing head is thereafter pushed in that direction in a straight manner. Steering means B has a retracted position as shown in FIG. 3 and an extended position, as can best be seen in FIG. 1. Steering wedge B must be rotated before it is extended and is retracted after the pipe jacking head has been brought back to a desired path position.

A rotary sensor means (FIG. 3) is shown which includes a rotary sensor 71 attached to a tail shaft 44*c* of hydraulic motor 44 for measuring the rotation of shaft 44*a* of motor 44 as it rotates 359 degrees between rotation stops 51 and 51*a*, in counter-clockwise turns. The rotational position of steering wedge 69 can be detected by detecting this rotational position of hydraulic motor shaft 44*a* since there is a 1:1 correspondence. Rotary sensor means 71 generates a rotation position signal 71*a* representing the rotational position of steering wedge B. Rotary sensor means 71 may be any suitable rotary sensor such as a high resolution laser rotary encoder manufactured by Cannon USA, Inc. of Lake Success, N.Y. There is an encoder disk 71*b*, having one degree increments read by sensor 71, freely carried on tail shaft 44*c*. Encoder disk 71*b* is gravity referenced by a pendulum mass 71*c*. Encoder disk 71*b* is maintained in a vertical position by the pendulous mass while rotary sensor 71 rotates with the wedge B and shaft of hydraulic motor 44. In the illustrated embodiment, the rotational position of steering wedge B is referenced to the vertical.

Guidance means are provided for measuring the position of the pipe jacking head. It is desirable to measure the position of the pipe jacking head in both the vertical plane and horizontal plane. For this purpose, an inclinometer 70 is provided which measures the position angle of the pipe jacking head about a horizontal axis and generates a first position signal 72 corresponding to the vertical position angle in terms of up and down position in tenths of degrees. A second sensor means for measuring the position of pipe jacking head A in a horizontal plane includes a directional heading sensor 74 carried centrally within the interior diameter of forward pipe casing 14*a* for generating a second position signal 76 corresponding to the horizontal position angle or heading of the pipe casing and pipe jacking head. Inclinometer 70 may be any suitable inclinometer such as a digital angle star protractor manufactured by Lucas Sensing Systems, Inc. Preferably, heading sensor 74 is a KVH directional heading sensor, model C-100, manufactured by KVH Industries of Middletown, R.I. That heading sensor is a miniature device which may easily fit within the pipe casing and measure the direction in which the pipe jacking head points or heads at any instant. The heading is expressed in angular units from a reference direction, usually from zero degrees at the reference direction clockwise 360 degrees. In accordance with the present invention, the directional heading sensor manufactured by KVH using a toroidial fluxgate magnetometer having a free floating ring core in the center, is particularly advantageous because it does not require the gimballed structure of a conventional magnetometer. The free floating ring core floats like a bobbin and has been found to be accurate within plus or minus 16 degrees of roll or pitch variation when used to measure heading in a pipe jacking head according to the invention. In contrast to the use of magnetometer systems, the guidance system of the invention can be used in steel pipe which is much cheaper than stainless steel or monel metal pipes, which are non-magnetic. The guidance system can be used in steel pipe without affecting accuracy because of its auto-calibration circuitry of the KVH sensor 74, as identified above, which compensates very precisely for hard and soft iron errors introduced by steel pipe around the sensor.

To calibrate sensor 74, the sensor is installed in pipe casing 14*a*, placed in the calibration mode, and the pipe is slowly moved left and right 20° to 30°, at 2° to 3° intervals, with a pause for several seconds at each point. A window average is then taken. Compensation means is provided by sensor 74 which includes a microprocessor that decides which of the reading groups to sample by looking at the stability of the readings within the groups. The unit then calibrates a series of auto-compensation factors which are entered into EEPROM memory. These constants define a compensation equation which automatically corrects the output heading. The compensating means or microprocessor also includes an auto-compensation algorithm which also compensates for magnetic field anomalies caused by a magnetic signature of steel utilities that the pipe jacking head might be going over or under. In this case, computer 90 holds the last reading and displays an invalid data message until the pipe jacking head was past this unknown magnetic signature. This feature is valuable because without it, an unknown magnetic signature would introduce errors indicating a deviation of left or right which would not be true. The data is integrated and may be averaged for 5 seconds to remove jitter caused by the vibration. The combination of these features make sensor 74 unique compared to magnetometer guided systems.

A conventional microprocessor 80 may be utilized to receive sensor signal 76 and convert the signals into serial data which may be transmitted by an RS-232 line at 76*a* through a suitable cable shielding 82. Likewise, a microprocessor 80 can be utilized to convert the position signal 72 from inclinometer 70 into serial data which can be transmitted over an RS-232 line at 72*a* through cable shield 82 for processing by a computer 90 and displayed on a display 92. Rotation position signal 71*a* from rotary sensor 71 may be done likewise. The position signals 76 from heading sensor 74 may be displayed as left and right position angle signals in terms of tenth of degrees. The position signal 72 from inclinometer 70 may be displayed as up and down positions displayed in tenths of degrees. Rotation position signal 71*a* is processed and displayed in graphic form about a compass rose 92*a* on display 92. Microprocessor 80 may be any conventional microprocessor such as a ADC 1001 manufactured by National Semiconductor which receives the position signals and a Max-232 circuit manufactured by Max & Company which buffers and drives the signal along the RS-232 line for display at computer 90. Computer 90 and display 92, of course, will be utilized at the boring station 10 along with controls 44*b* for rotating steering wedge B and controls 60*b* and 64*b* for extending and retracting steering wedge B, respectively. A plot of a desired path for a cased bore formed by pushing pipe casings 14 through the ground may be drawn before the pipe laying operation begins. The distance of front end 74 of pipe jacking head A may be determined by measuring the length of pipe casings which has been pushed through the ground by measuring the pipe casing links at the boring station 10. Thus, by knowing the horizontal and vertical positions of pipe jacking head A on display 92, and the distance by measuring pipe casing links, or by any other suitable distance measuring means, the exact position of the pipe jacking head may be determined at all times. By comparing this position to the desired path of the pipe jacking head and pipe casings, deviations in the position of the pipe jacking head and pipe casings from the desired path may be determined on the display. The operator of the steerable pipe jacking head may control the position of the steering wedge B accordingly and extend that steering wedge to steer pipe jacking head A in a desired direction and bring the pipe jacking head back to its nominal position along the desired path. When the pipe jacking head has reached its nominal position, steering wedge B may be retracted and the pipe steering head may continue to be pushed through the ground in that direction until it again deviates or until a direction change is required from the plot as read by the operator.

While a preferred embodiment of the invention has been described using specific terms, such description is for illustrative purposes only, and it is to be understood that changes and variations may be made without departing from the spirit or scope of the following claims.

What is claimed is:

1. Apparatus for laying pipe casings underground to form a cased bore which includes means for pushing a string of pipe casings joined together through the ground, and a forward pipe casing at a forward end of said string of pipe casings, said apparatus comprising:

a steerable pipe jacking head carried by said forward pipe casing;

a steering means carried by said pipe jacking head for creating a directional steering force to steer said head in a prescribed direction;

said steering means having a desired rotational position in which said steering means creates said directional steering force to steer said pipe jacking head, and said steering means having an advanced position in which said steering means is extended forward of said pipe jacking head to steer said pipe jacking head, and a retracted position in which said steering means is retracted within said pipe jacking head so that said directional force is not created; and actuation means for rotating said steering means to a desired rotational position to create said directional steering force and steer said pipe jacking head and said pipe casings in said prescribed direction for moving said steering means between said advanced and retracted positions.

2. The apparatus of claim 1 wherein said actuator means includes a first actuator means for rotating said steering means to said desired rotational position to steer said head in said prescribed direction, and a second actuator means for reciprocating said steering means in and out of said pipe jacking head between said advanced and retracted positions.

3. The apparatus of claim 2 wherein said second actuator means includes a fluid cylinder having a piston rod, and said steering means includes a piston carried by said piston rod.

4. The apparatus of claim 3 wherein said steering means includes a wedge moved between said advanced and retracted positions by said piston rod, said wedge having a slanted surface which creates said directional force.

5. The apparatus of claim 3 wherein said fluid cylinder includes a double-acting piston which is urged in opposing reciprocating motion by pressurized fluid.

6. The apparatus of claim 5 wherein said fluid cylinder includes a first end cap and a second end cap, a slidable piston carried between said first and second end caps, an advance port for admitting pressurized fluid in a space between said first end cap and said slidable piston, and a retract port for admitting pressurized fluid in a space between said second side of said slidable piston and said second end cap.

7. The apparatus of claim 6 including a bore formed in said piston rod for delivering pressurized fluid to said retraction port.

8. The apparatus of claim 3 wherein said first actuating means includes a drive motor for rotating said steering means to said desired rotational position, and coupling means connecting said steering means and drive motor for rotating said steering means and permitting said steering means to be extended along a longitudinal axis of said pipe jacking head.

9. The apparatus of claim 8 wherein said coupling means comprises a splined coupling having a plurality of splines, and said piston rod includes a free end having a plurality of splines which mesh with said splined coupling.

10. The apparatus of claim 8 including first control means for controlling said drive motor.

11. The apparatus of claim 10 including second control means for controlling the admission of pressurized fluid to said fluid cylinder to advance and retract said steering means.

12. The apparatus of claim 10 wherein said drive motor is a fluid motor.

13. The apparatus of claim 3 wherein said first actuator means includes a coupling means connected to said piston rod of said fluid cylinder, a drive motor for rotating said coupling means so that said piston rod and steering means are turned to said desired rotational position and thereafter allows said steering means to be moved axially by said piston rod relative to said coupling means to said advanced position for steering said pipe jacking head, and thereafter to retracted position where said pipe jacking head proceeds in said prescribed direction.

14. The apparatus of claim 2 wherein said second actuator means includes a coupling means connected to said piston rod of said fluid cylinder, a drive motor for rotating said coupling means so that said piston rod and steering means are turned to said desired rotational position and thereafter allows said steering means to be moved axially by said piston rod relative to said coupling means to said advanced position for steering said pipe jacking head, and thereafter to retracted position where said pipe jacking head proceeds in said prescribed direction.

15. The apparatus of claim 14 wherein said coupling means comprises a splined coupling having a plurality of splines, and said piston rod includes a free end having a plurality of splines which mesh with said splined coupling.

16. The apparatus of claim 14 including first control means for controlling said drive motor.

17. The apparatus of claim 2 wherein said steering means includes a steering wedge having a slanted face which creates said prescribed directional force, and said first actuation means rotates said steering wedge before said second actuation means extends said wedge from said pipe jacking head.

18. The apparatus of claim 17 including:

guidance means for measuring an inclination and a heading of said pipe jacking head and for generating corresponding first and second position signals; and control means for controlling said actuation means in response to said first and second position signals to control said steering means to steer said pipe jacking head according to a prescribed path.

19. The apparatus of claim 18 wherein said guidance means includes:

first sensor means for measuring said inclination of said pipe jacking head and generating said first position signal; and second sensor means for measuring said heading of said pipe jacking head and generating said second position signal.

20. The apparatus of claim 19 including rotary sensor means for detecting said rotational position of said steering means and generating a rotational position signal.

21. The apparatus of claim 19 including computer means for processing said first and second position signals for calculating vertical and horizontal deviations of said pipe jacking head with respect to said prescribed path, and for processing said rotational position signal.

22. The apparatus of claim 20 including a visual display which graphically displays said deviations of said pipe jacking head, and said rotational position of said steering means.

23. The apparatus of claim 22 wherein said control means comprises manually operated control means for controlling said actuation means in response to said display of deviations and rotational position to move said steering means and steer said pipe jacking head to nullify said deviations.

24. The apparatus of claim 19 wherein said second sensor means includes a magnetometer sensor, and compensation means for compensating for magnetic field anomalies to eliminate errors in said second position signal caused by said field anomalies.

25. Apparatus for laying pipe casings underground to form a cased bore which includes means for pushing a string of pipe casings joined together through the ground, and a forward pipe casing at a forward end of said string of pipe casings, said apparatus comprising:

a steerable pipe jacking head carried by said forward pipe casing;

a steering means carried by said pipe jacking head for creating a directional steering force for steering said head in a prescribed direction;

said steering means having a desired rotational position in which said steering means creates said directional steering force to steer said pipe jacking head, and said steering means having an advanced position in which said steering means is extended forward of said pipe jacking head to create said directional steering force, and a retracted position in which said steering means is retracted into said pipe jacking head so that said directional force is not created;

actuation means for moving said steering means between said advanced and retracted positions and for rotating said steering means to said desired rotational position to impart said directional steering force to steer said pipe jacking head and said pipe casings in said prescribed direction; and guidance means for measuring an inclination and heading of said pipe jacking head and generating first and second position signals corresponding to vertical and horizontal positions of said pipe jacking head.

26. The apparatus of claim 25 wherein said guidance means includes:

first sensor means for measuring said inclination of said pipe jacking head and generating said first position signal; and second sensor means for measuring said heading of said pipe jacking head and generating said second position signal.

27. The apparatus of claim 26 including rotary sensor means for detecting said rotational position of said steering means and generating a rotational position signal.

28. The apparatus of claim 27 including computer means for processing said first and second position signals for calculating vertical and horizontal deviations of said pipe jacking head with respect to said prescribed path, and for processing said rotational position signal.

29. The apparatus of claim 28 including a visual display which graphically displays said deviations of said pipe jacking head, and said rotational position of said steering means.

30. The apparatus of claim 29 wherein said control means comprises manually operated control means for controlling said actuation means in response to said display of deviations and rotational position to rotate and extend said steering means to steer said pipe jacking head and nullify said deviations.

31. The apparatus of claim 26 wherein said second sensor means includes a magnetometer sensor, and compensation means for compensating for magnetic field anomalies to eliminate errors in said second position signal caused by said field anomalies.

32. A method for steering and guiding a steerable pipe jacking head which lays pipe casings underground, comprising:

providing a steerable pipe jacking head having a steering means which is rotated within said pipe jacking head to a desired rotated position which corresponds to a desired steering direction, and then is extended from said pipe jacking head to steer said pipe jacking head, and then retracted so as not to steer said pipe jacking head;

measuring the position of said pipe jacking head as it is pushed through the ground to lay pipe casings and generating position signals; and rotating and then extending said steering means in response to said position signals to steer said pipe jacking head as it is pushed through the ground in a prescribed direction along a desired path, and retracting said steering means after said pipe jacking head has been steered to said prescribed direction.

33. The method of claim 32 wherein said steering means is provided in the form of a steering wedge having a slanted surface which creates said directional force to steer said pipe jacking head.

34. The method of claim 32 including measuring said position of said pipe jacking head by measuring the inclination and heading of said pipe jacking head, and generating inclination and heading signals.

35. The method of claim 34 including detecting a rotational position of said steering means and generating a rotational position signal.

36. The method of claim 35 including controlling the rotational position of said steering means in response to said inclination and heading signals and rotational position signal to steer said pipe jacking head in said prescribed path.

* * * * *